United States Patent [19]

Fredd

[11] 4,274,486

[45] Jun. 23, 1981

[54] APPARATUS FOR AND METHOD OF OPERATING A WELL

[75] Inventor: John V. Fredd, Dallas, Tex.

[73] Assignee: Otis Engineering Corporation, Dallas, Tex.

[21] Appl. No.: 94,941

[22] Filed: Nov. 16, 1979

[51] Int. Cl.[3] ..... E21B 23/02; E21B 33/12; E21B 34/10; E21B 47/06

[52] U.S. Cl. ..... 166/250; 166/113; 166/142; 166/319; 166/332

[58] Field of Search ..... 166/250, 315, 319, 320, 166/332, 334, 142, 143, 152, 264, 113

[56] References Cited

U.S. PATENT DOCUMENTS

| | | | |
|---|---|---|---|
| 3,493,052 | 2/1970 | Evans et al. | 166/332 X |
| 3,575,237 | 4/1971 | Malone | 166/152 |
| 3,964,556 | 6/1976 | Gearhart et al. | 166/319 X |
| 3,965,978 | 6/1976 | Conley et al. | 166/250 X |
| 3,970,147 | 7/1976 | Jessup et al. | 166/250 |
| 4,069,865 | 1/1978 | Gazda et al. | 166/152 X |

*Primary Examiner*—Stephen J. Novosad
*Attorney, Agent, or Firm*—Vinson & Elkins

[57] ABSTRACT

Apparatus and system for testing and producing a well in which the well is controlled adjacent the producing formation and may be shut-in or permitted to flow at the discretion of the operator. The well may be tested under flowing or shut-in conditions and after testing is completed the tubing may be hung off in the well with the well shut-in adjacent the producing formation.

9 Claims, 12 Drawing Figures

APPARATUS FOR AND METHOD OF OPERATING A WELL

This invention relates to wells and more particularly to apparatus and method for operating wells.

After drilling operations are completed it is desirable to test a well under both static and flowing conditions and it is further desirable to be able to alternately flow and shut-in the well and to repeat such operations as the operator desires to determine the condition of the well. Desirably, this is done under conditions in which the well is completely under control. It is further desirable if for any reason the test string must be manipulated that the well be shut-in adjacent the producing formation during such manipulation to provide maximum control of the well. It is further desirable that in the event the well is not to be completed for some time that well be shut-in while awaiting completion at a point adjacent the producing formation after testing operations have been completed, and that circulation is possible through the casing and tubing so that the well fluids above the shut-in point may be conditioned as desired.

It is also desirable that a well be protected against abnormal conditions which may from time to time occur, particularly with offshore wells, and the apparatus and method of this invention may be utilized to automatically shut-in the well adjacent the producing formation upon an abnormal reduction in tubing pressure.

The use of foot valves of the ball valve type is old. It is also old to use the weight of a section of the tubing in controlling operation of a valve. See my U.S. Pat. No. 3,494,417.

It is an object of this invention to provide apparatus and method for operating a well in which a packer having a depending foot valve and landing nipple may be set in a well and a pressure sensitive device be provided in the landing nipple and the foot valve selectively opened and closed to flow the well and to determine pressure conditions with the well shut-in.

Another object is to provide an apparatus and system as in the preceding object in which if desired a wireline removable plug may be provided in the landing nipple which is removed and replaced by the pressure sensing means after the packer has been landed.

Another object is to provide apparatus and method for a well in which a packer having a depending foot valve is provided in the well and the foot valve is opened and closed by raising and lowering a valve actuator carried on the lower end of the tubing.

Another object is to provide apparatus and method as in the preceding object in which the valve actuator may be raised and lowered by reciprocating the tubing and by raising and lowering pressure within the casing-tubing annulus.

Another object is to provide an apparatus and method for operating the well as in the preceding object in which the opening and closing of the foot valve by raising and lowering annulus pressure may be repeated as many times as desired and while the foot valve is open and closed pressure and other conditions in the bottom of the well adjacent the foot valve may be recorded or may be transmitted back to the surface.

Another object is to provide apparatus and method for a well in which a packer having a depending foot valve is set and in which the foot valve may be opened and closed at will so that with the well shut-in at the packer tubing may be manipulated, and transducers and the like may be run into the well under conditions of maximum safety.

Another object is to provide apparatus and method as in the preceding object in which the fluid in the annulus and the tubing may be conditioned in any manner desired with the well in the shut-in condition.

Another object is to provide apparatus and method for testing and completing a well in which the well may be shut-in adjacent the producing formation and the tubing utilized during the testing operations hung off in the well with the well shut-in adjacent the producing formation and the pressure within the tubing and in the annulus equalized.

Another object is to provide a testing and completion system in which after the well is tested the well is shut-in adjacent the formation and the tubing may be manipulated to provide surface controlled subsurface safety valves, install Christmas trees and the like, with the well under complete control due to its shut-in condition.

Another object is to provide an apparatus and method for a well in which the well is controlled by a foot valve located beneath the packer and in which upon a reduction in tubing pressure the foot valve will close shutting in the well to protect the well against abnormal conditions.

Other objects, features and advantages of this invention will be apparent from the drawings, the specification, and the claims.

In the drawings wherein illustrative embodiments of this invention are shown and wherein like reference numerals indicate like parts:

The method of this invention is generally illustrated by FIGS. 1 through 10 which generally show the sequential operations involved in testing and completing a well in accordance with this invention.

Figure 1:
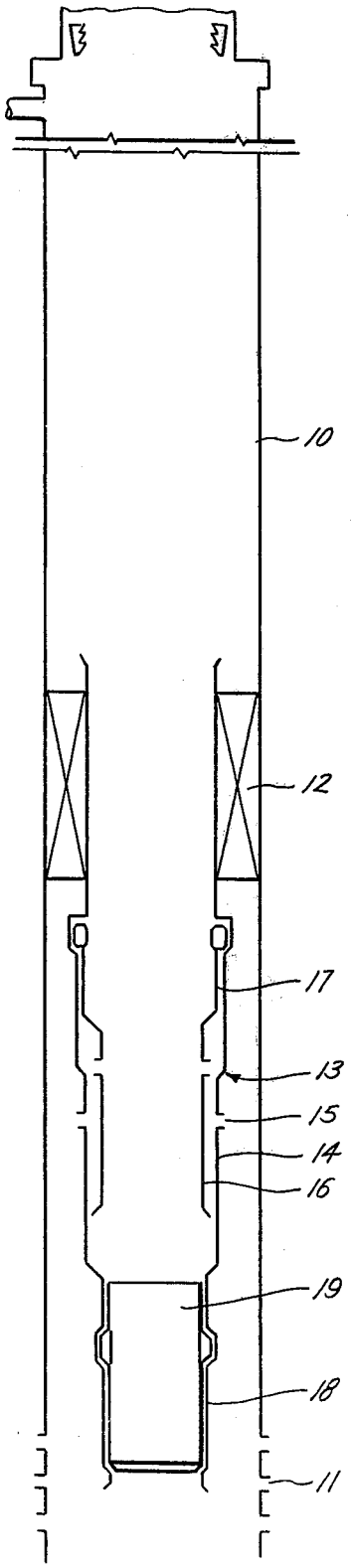
FIG. 1 is a schematic view of a well having a packer with depending foot valve and landing nipple with a plug shown in the landing nipple.
Figure 2:
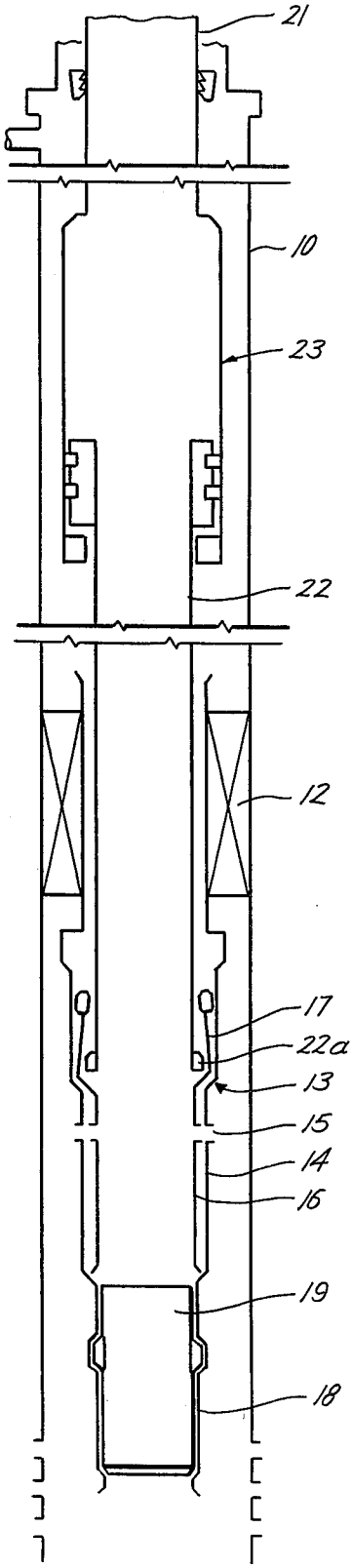
FIG. 2 is a view similar to FIG. 1 showing a tubing to have been landed in the packer.

Referring first to FIG. 1, a well is shown having a casing 10 which is perforated at 11 to open the casing to the producing formation. Although not shown, the well may be considered to be full of the drilling fluid in place at the time that the last section of casing was set and perforation operations were carried out.

A packer 12 has been run on a wireline and set in the conventional manner above the perforations 11. Preferably, the packer would be set fairly close to the perforations so that the testing equipment would be placed in the general vicinity of the producing formation.

The packer has depending therefrom a foot valve indicated generally at 13. The foot valve includes a housing 14 having a plurality of ports 15 therethrough. The foot valve is preferably of the sleeve type in which the sleeve valve member 16 is reciprocated vertically to control flow through the ports 15. The valve member 16 has a collet 17 which is engaged by a valve actuator, disclosed hereinbelow, to open and close the foot valve. With the packer set in the well, the opening and closing of the foot valve 13 controls flow from the formation into the well above the packer.

Depending from the foot valve is a landing nipple 18. In the form of the system shown in FIG. 1 it is preferred that a standard landing nipple which will sealingly receive a locking mandrel carrying a transducer fitting be utilized.

In the drawing a locking mandrel 19 carrying a conventional wireline plug is shown to be landed in the landing nipples to close off the bottom of the foot valve 13.

The packer is preferably run with the foot valve 13 in closed position as shown so that when the packer is set the producing formation will be isolated from the well above the packing.

The packer 12 may be any desired type of packer and is preferably a wireline packer, which is run and set on a wireline.

With the well shut-in by the system shown in FIG. 1, the tubing indicated generally at 21 is run into the hole. The tubing 21 carries at its lower end a valve actuator 22 which is suspended from the tubing 21 by a telescoping joint indicated generally at 23. It will be appreciated that the valve actuator 22 is actually a part of the overall tubing 21 and that the valve actuator sealingly engages the bore through the packer 12.

As will be explained more in detail hereinafter, the weight of the valve actuator 22 and the differential across the telescoping connection 23 are utilized to control opening and closing of the foot valve. As the tubing is run there will be no differential across the telescoping joint 23 and the weight of the actuator 22 will cause it to be in its down position. Thus, as the tubing is run into the well and the valve actuator sealingly stabbed into the packer, the actuator flange 22*a* on the valve actuator will engage the collet 17 of the foot valve and move the valve member 16 to its down position as shown, thus opening the well. It is not necessary that the valve 13 be opened at this time, but it will normally occur in the process of landing the tubing in the packer. It is preferred that the valve be opened as the next step is to pull the plug from the bottom of the system and it is preferable that there not be any pressure differential across the plug as it is pulled.

The step of pulling the plug is not shown but this step is carried out in the conventional manner utilizing conventional wireline techniques. The step of pulling the plug is not shown because it is not necessary to the practice of the method that a plug be run in with the packer. The landing nipple may be left open. It is preferred, however, that the packer be run with a plug in place as this shuts-in the well and maintains it under positive control adjacent the formation during running of the tubing 21.

Figure 3:
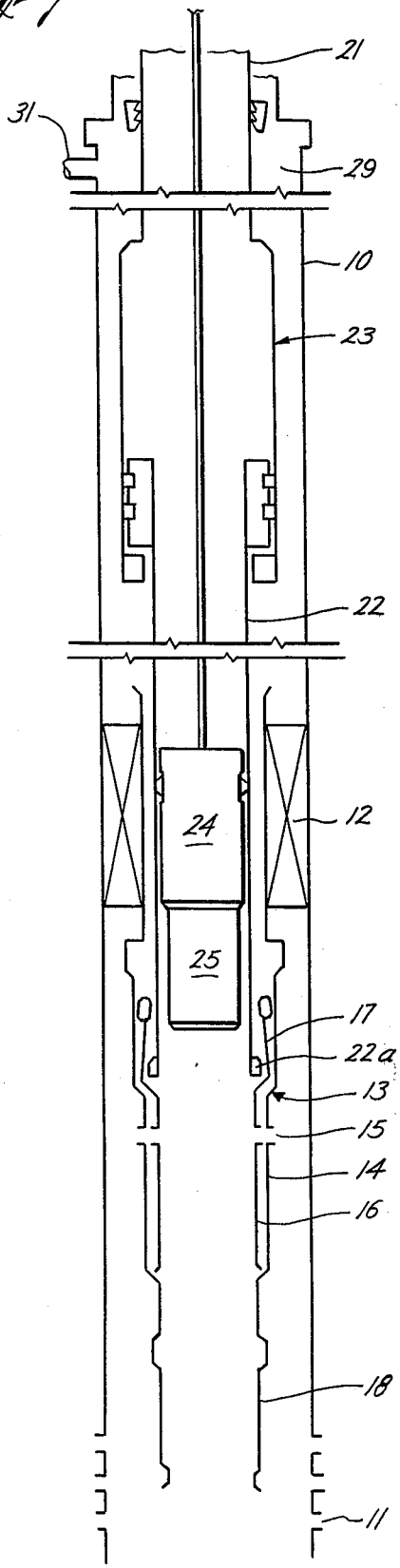
FIG. 3 is a view similar to FIG. 2 showing a transducer fitting being run to be set in the landing nipple.
Figure 4:
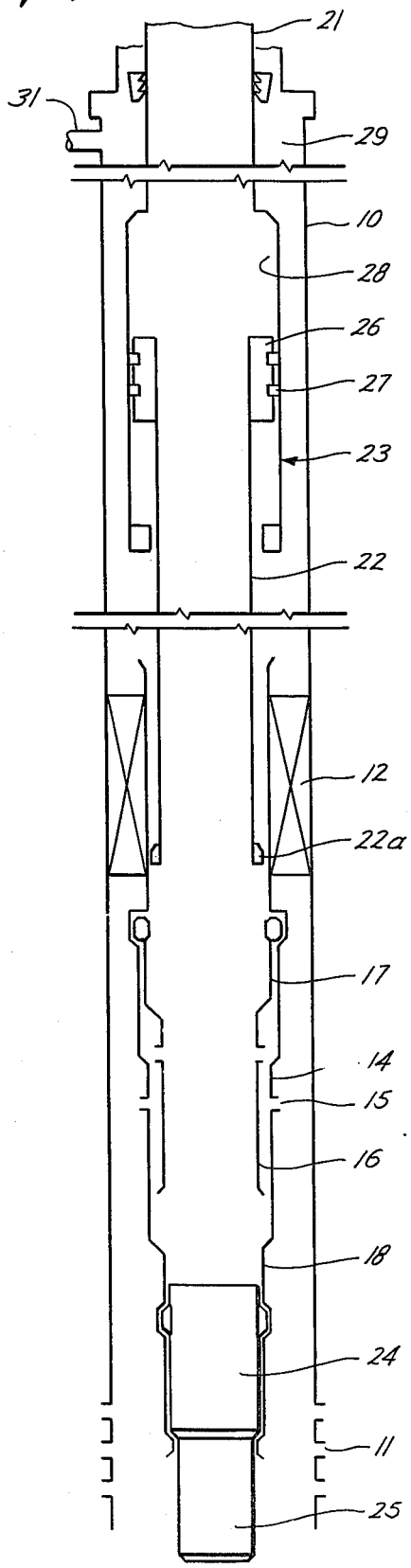
FIG. 4 is a view similar to FIG. 3 showing the transducer fitting to be landed and the annulus to be pressurized to move the valve to closed position.

After the plug has been pulled a locking mandrel 24 carrying a transducer fitting 25 is run into the well and landed in the landing mandrel 18 as shown in FIG. 3. The transducer fitting is closed to the passage of well fluids therethrough, except when a transducer has been landed in the fitting and thus in the system as shown in FIG. 4, the bottom of the foot valve 13 is again closed to flow of well fluids.

The telescoping joint 23 includes a piston 26 having a seal member 27 in sliding sealing contact with the bore through the upper member 28 of the telescoping joint. The piston 26 is carried on the lower member 22 of the telescoping joint. The effective area of the seal 27 is larger than the effective area of the seal between the packer bore and the valve actuator. Thus, pressure within the annulus 29 acts in an upward direction on the piston 26 against the pressure within the tubing and against the weight of the valve actuator 22. After the transducer fitting is landed pressure is introduced into the annulus 29 to raise the valve actuator 22 and close the foot valve 13, as shown in FIG. 4. With the foot valve closed the formation is again shut-in at the foot valve.

Figure 5:
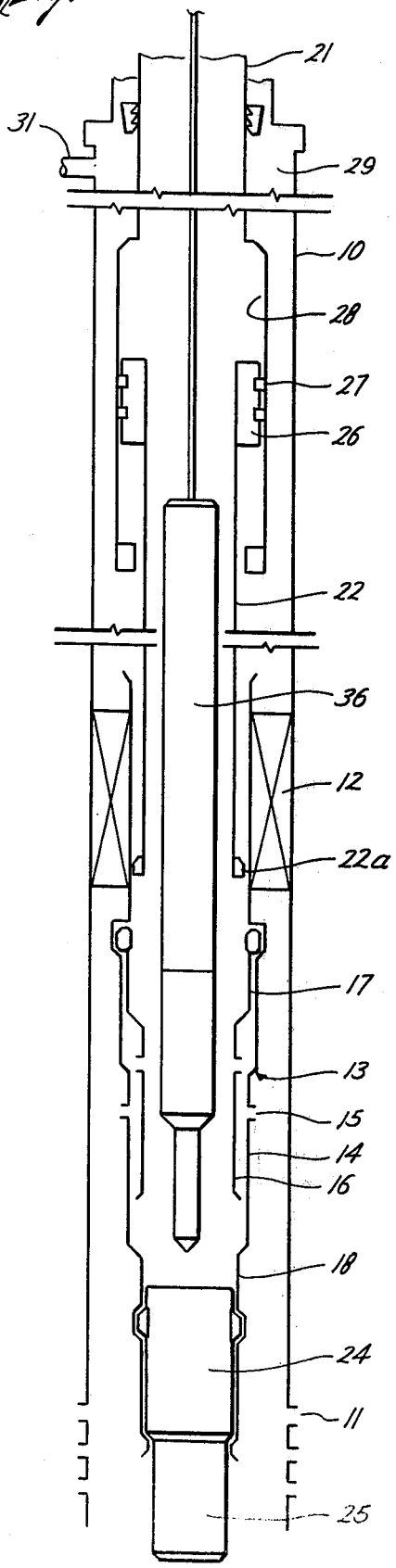
FIG. 5 is a view similar to FIG. 4 showing a transducer being run.

At this time, as shown in FIG. 5, the transducer 36 may be run into the well on a wireline and landed in the transducer fitting 25. It will be apparent that the transducer 36 could have been run before the foot valve was moved to closed position, but it is preferred to first close the foot valve and then run the transducer and land it in the transducer fitting 25. It is preferred to run the transducer with the well shut-in as the transducer will be transmitting through the wireline from which it is suspended information during the time it is being run. Thus, the transducer can transmit to the surface information about the bottom hole pressure in the tubing. Thus, if before landing the tubing the operator had chosen to lighten fluid in the tubing as by injecting nitrogen into the tubing to achieve a desired bottom hole pressure at the bottom of the tubing, this desired pressure could be verified by the transducer and if not as desired the tubing pressure could be changed to provide the desired tubing pressure prior to again opening the foot valve 13.

Once the transducer 36 is landed it will be transmitting back to the surface the bottom hole pressure in the casing below the packer. This permits the operator to compare the bottom hole pressure in the well and the bottom hole pressure in the tubing, that is, across the foot valve 13 and as indicated above correct if desired the pressure within the tubing to obtain the desired differential across the foot valve prior to opening the foot valve.

Figure 6:
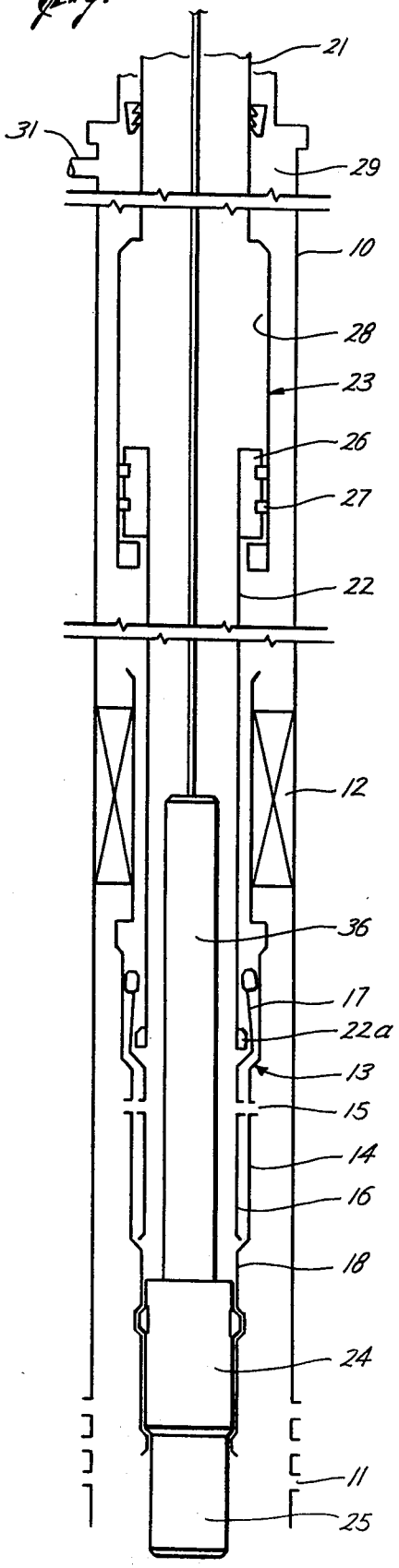
FIG. 6 is a view similar to FIG. 5 showing the transducer landed in the transducer fitting and the annulus depressurized to move the valve to open position and flow the well during the test cycle.

After desired pressure readings are taken with the transducer in place, the pressure within the annulus is reduced as indicated in FIG. 6 to permit the tubing pressure and the weight of the valve actuator 22 to move the valve actuator down and open the foot valve 13. This permits the well to flow in the conventional manner through the tubing to the surface to permit the operator to obtan data from the flowing fluid and from the transducer while the well is flowing.

Figure 7:
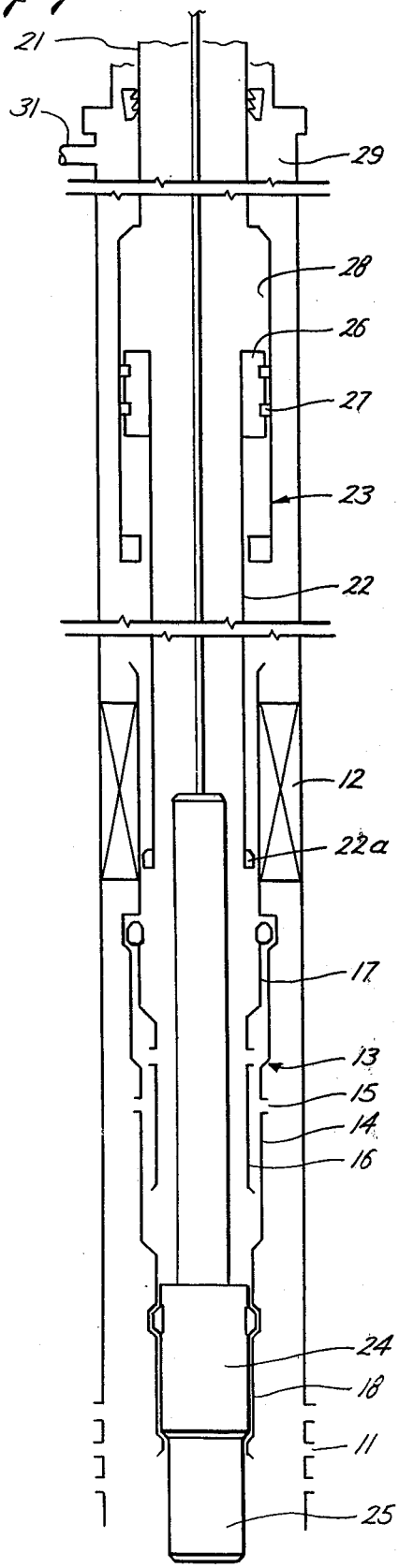
FIG. 7 is a view similar to FIG. 6 showing the well annulus to have been pressurized to move the foot valve to closed position to permit testing of the well under shut-in conditions.

After the desired data is obtained with the valve open, the foot valve 13 is again closed as indicated in FIG. 7 by introducing pressure into the annulus on top of the column of fluid in the annulus to permit the pressure exerted by the fluid in the annulus at the telescoping joint to raise the valve actuator against tubing pressure and the weight of the valve actuator to again close the valve as shown in FIG. 7. The well would normally be maintained in this condition for sufficient time to obtain a pressure build-up curve and any other data which might be sensed at the transducer and transmitted to the surface.

It will be apparent that by raising and lowering pressure within the annulus the foot valve may be opened and closed at the will of the operator to obtain shut-in and flowing well data and such cycles of opening and closing may be repeated as many times and the well may remain open or closed for as long a period of time as the operator may desire.

After testing has been completed, the well may be completed in the conventional manner if desired. It is frequently desirable, however, to not complete the well for a considerable period of time as, for instance, where the well is one of several being drilled from a central platform or where the well is one of several which will ultimately produce into a gathering system not yet in existance, and in this case it is desirable to shut-in the well and leave it for future completion.

Figure 8:
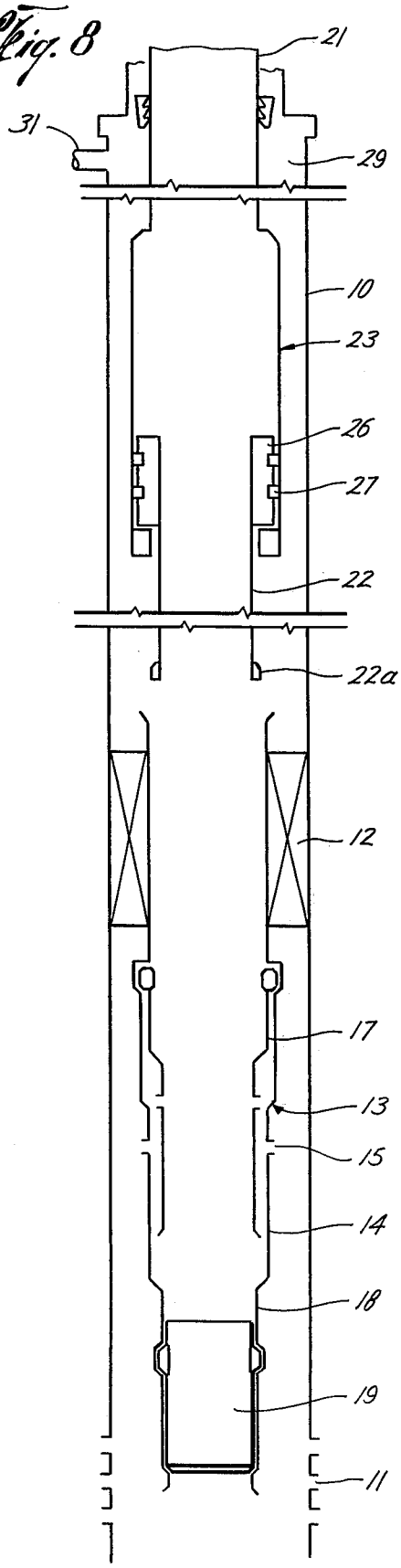
FIG. 8 is a view showing the tubing to have been raised to close the foot valve and the tubing to be suspended in the well above the packer awaiting final completion of the well.

To shut-in the well for future completion the transducer is first removed from the well and replaced with a wireline plug. This may be done with the foot valve in open or closed condition. After the transducer is removed and the plug in place the tubing is rasied to the position shown in FIG. 8 in which the actuator is moved to an upper position closing the foot valve 13 to shut-in the well below the packer. Preferably, the tubing is raised as shown in FIG. 8 to a point where the packing on the valve actuator disengages the bore of the packer 12. This height is not absolutely necessary as the well could be shut-in by raising the tubing only enough to operate the foot valve, but it is preferred at this will equalize pressure within and without the tubing. The tubing and casing annulus, again, can be filled with any desired material or the weight of material in the tubing and annulus may be changed at this time by circulation. The tubing may be hung off at the surface in the conventional manner and may be closed by a cap or any other type of closure at the surface. The flowway 31 into the annulus 29 may also be closed at this time. As the foot valve is closed the well is controlled adjacent the formation and the closures at the surface and the type of fluid within the tubing and casing act as secondary closures for the well.

Figure 9:
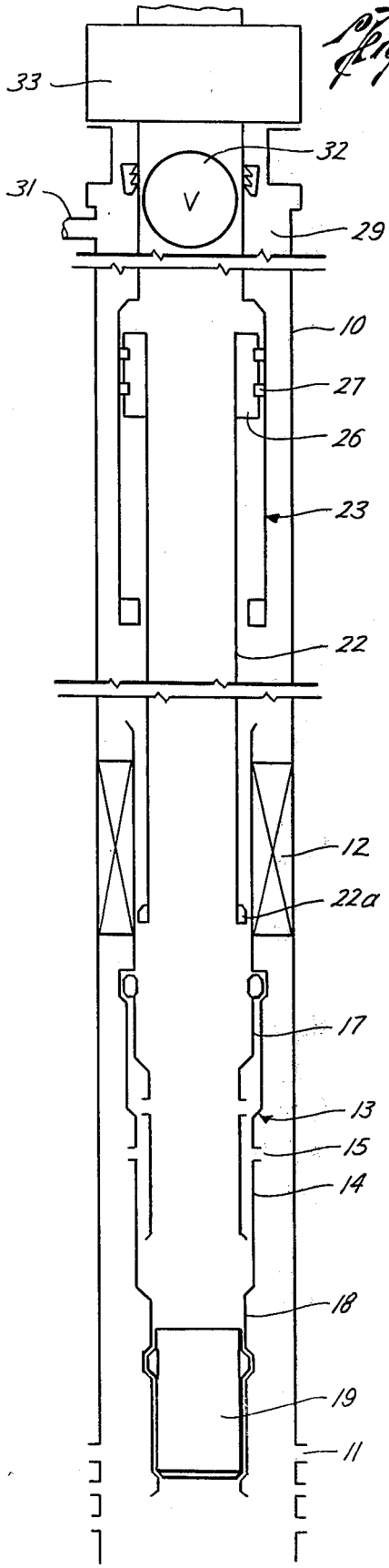
FIG. 9 is a view similar to FIG. 8 showing the annulus pressurized to close the valve and the tubing to have had installed therein the surface controlled subsurface safety valve and the well to have been completed with the usual Christmas tree.

Whenever it is desired to complete the well, that is, after testing or at some later date, the tubing is positioned to close the foot valve as explained hereinabove and shut-in the well at the foot valve. The tubing may then be manipulated to install a surface controlled subsurface safety valve such as indicated schematically at 32, to install a Christmas tree such as indicated schematically at 33, or carry out any other desired operations in the completion of the well. The well is finally completed with the tubing supported in the tubing head in the conventional manner with the valve actuator 22 positioned so that as it is raised and lowered it will open and close the foot valve. For instance, as shown in FIG. 9, the relationship could be such that with the piston 26 in the full up position the actuating flange **22*a* is immediately above the collet 17. It will be understood that during the completion of the well, that after the tubing is lowered into a position where the actuator 22 is in engagement with the packer 12, the well may be continued to be controlled by the foot valve 13 by the introduction of pressure through the line 31 into the annulus 29 to maintain the piston 27 in its upper position during the final completion of the well as shown in FIG. 9**.

Figure 10:
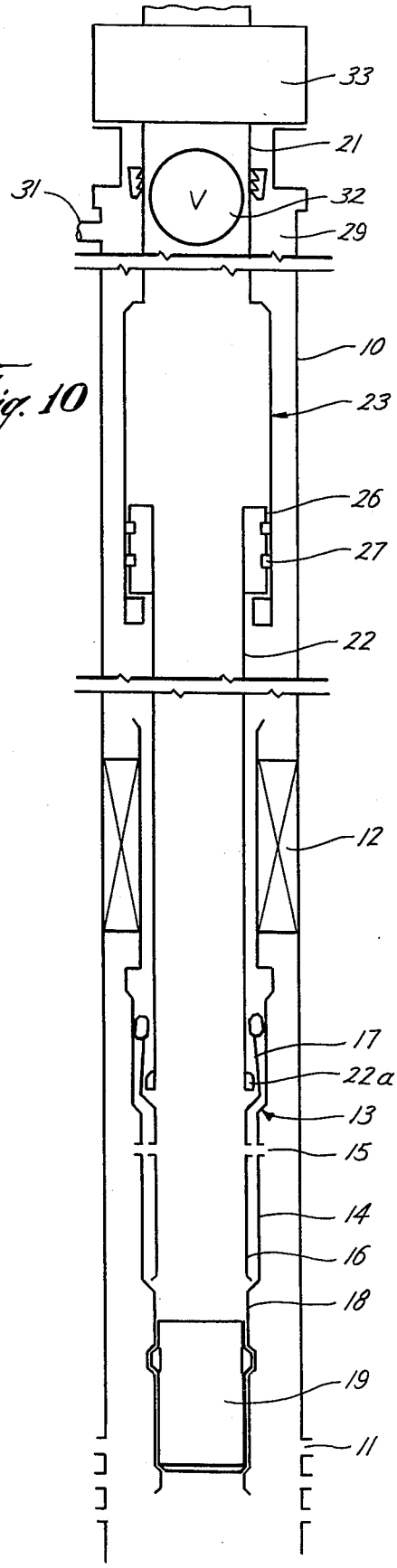
FIG. 10 is a view similar to FIG. 9 showing the annulus to have been relieved of pressure to close the foot valve and place the well on production.

After the well has been completed, the pressure within the annulus is relieved and the annulus fluid adjusted such that the hydrostatic pressure exerted at the telescoping joint 23 exerts a force which is less than the force exerted by tubing pressure with the well flowing in the normal conditions, plus the weight of the valve actuator. Under these conditions when the pressure is taken off of the annulus, the hydrostatic pressure exerted is not sufficient to maintain the valve actuator in the up position and the actuator moves to its down position as shown in FIG. 10 to place the well on production. The relationship of the forces exerted, however, are preferably such that in the event of a substantial reduction in tubing pressure such as, for instance, occasioned by a surface break which relieves back pressure against the tubing, the balance of forces across the telescoping joint are such that the annulus pressure at the telescoping joint is sufficient to raise the actuator 22 and move the foot valve to closed position to shut-in the well until such time as the condition which caused the reduction in pressure has been corrected and normal tubing pressure restored. Thus, with this invention the foot valve may provide a safety valve adjacent the formation which operates in the event of a loss in pressure at the surface in addition to the customary surface controlled subsurface safety valve 32.

Figure 11:
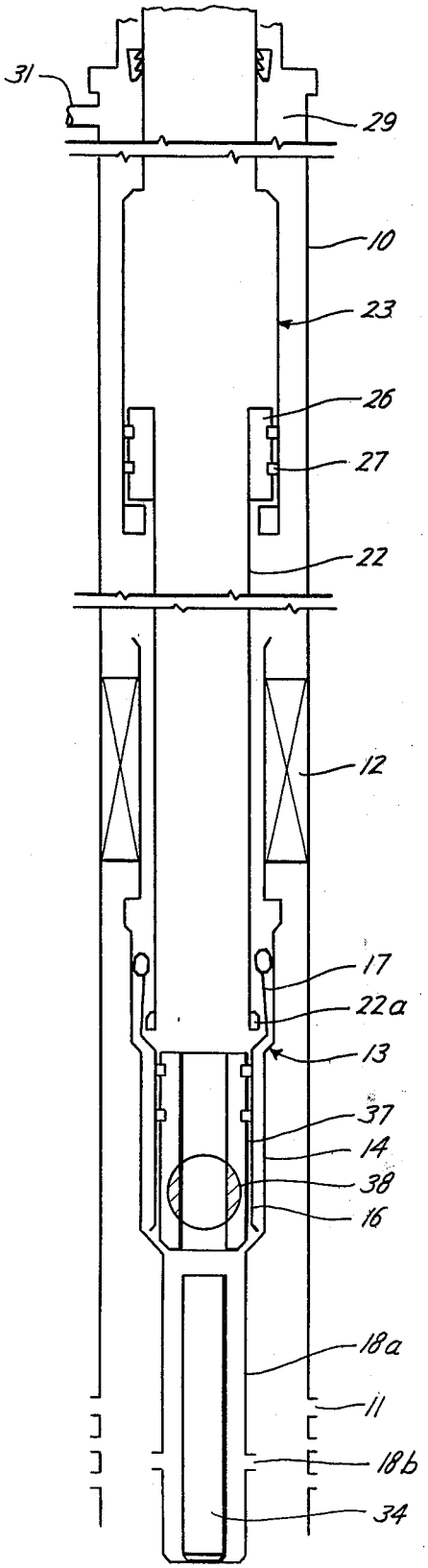
FIG. 11 is a view similar to FIG. 6 in which the foot valve is a ball valve and the transducer is a pressure bomb continuously recordng conditions at the bottom of the well.

In FIG. 11 there is shown an alternate form of system in which the foot valve is a ball valve 37 having a flowway 38 therethrough. The ball valve is conventional in form and is rotated by vertical reciprocation of the collet 17.

The landing nipple **18*a* differs in form from the landing nipple 18 in that it does not have provision for landing of a locking mandrel and in that it has open ports 18*b* therein. It is still, however, a landing nipple in the sense that it provides for the support of a structure such as the pressure bomb 34**.

The method employed with the ball valve 37 is generally the same as hereinabove discussed.

After the tubing is run the actuator 22 may be lowered to rotate the ball to its open position. At this time a pressure bomb 34 is run into the well on a wireline and passed through the flowway 38 through the ball valve 37 and landed in the landing nipple. The wireline is then disengaged so that the ball valve may be opened and closed at will by increasing and decreasing annulus pressure. The pressure bomb is preferably of the type that continuously records pressure conditions at the ports **18*b* for a substantial period of time. Thus, the well may be tested by opening and closing the ball valve 37 and the pressure bomb 34 will continuously record conditions in the bottom of the hole, whether the well be open or closed. After testing is completed the valve is again left in the open position and wireline techniques are utilized to retrieve the bomb 34** to return it to the surface where bottom hole pressure and other information recorded by the bomb can be reviewed. If desired, more than one pressure bomb can be run for a series of tests, at the discretion of the operator.

Figure 12:
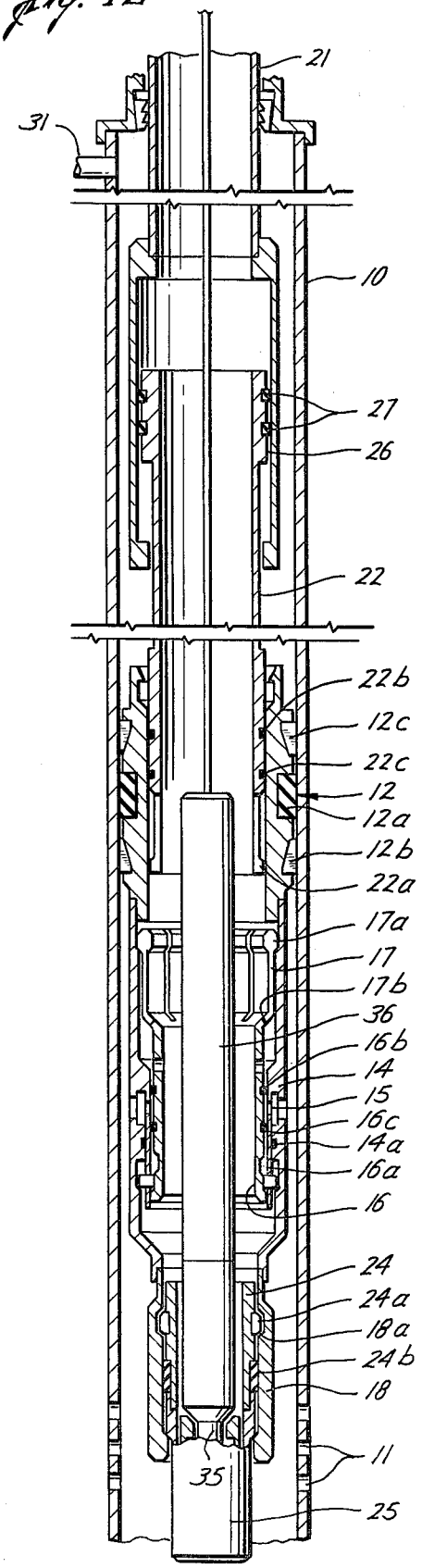
FIG. 12 is a schematic view showing more in detail the apparatus of FIGS. 1 through 10.

In FIG. 12 a more specific view is shown of the well equipment.

The packer indicated generally at 12 is shown to have the packing material 12*a* and slips 12*b* and 12*c*.

The foot valve 13 is shown to have the body 14 with ports 15. The valve member 16 is provided with a shutter 16*a* and spaced packing 16*b* and 16*c* which cooperate with packing 14*a* on the housing to control flow through the ports 15. The collet 17 is shown to have bosses 17*a* and an upwardly facing shoulder 17*b* against which the flange 22*a* on the actuator 22 may cooperate to raise and lower the valve member 16.

The landing nipple 18 is shown to have a locking groove 18*a* in which the dogs 24*a* of the locking mandrel 24 are engaged. The transducer fitting 25 is shown to depend from the locking mandrel 24. The mandrel 24 is provided with seals 24*b* to seal with the landing nipple. The transducer 36 is shown to have a prong 35 which extends into the transducer fitting 25. Not shown are packing which seal between the transducer and transducer fitting and the means for opening and closing a valve in the transducer fitting which, again, is not shown.

The actuator 22 is shown to have spaced seals 22*b* and 22*c* which sealingly engage with the bore through the packer 12. As noted hereinabove, the seals 27 on the piston 26 are of greater diameter than the seals 22*b* and 22*c* so that the desired pressure responsive area exposed to casing pressure is provided.

In my co-pending application Ser. No. 053,782 filed July 2, 1979, a foot valve is shown which may be utilized with this invention. In my co-pending application Ser. No. 056,886 filed July 12, 1979, there is shown a transducer and transducer fitting which may be utilized with this invention. In my co-pending application Ser. No. 078,712 filed Sept. 25, 1979, there is shown another form of transducer fitting and cooperative transducer which may be utilized in this invention. In my co-pending application Ser. No. 061,032 filed July 26, 1979, there is shown another foot valve and transducer fitting and associated transducer which may be utilized in this invention.

The disclosures of the above identified applications are incorporated herein in their entireties by reference.

It will be appreciated that the ball type foot valve and the sleeve type foot valve functionally interchangeable. Both have flow areas equivalent to full tubing I.D. and are pressure competent in both directions. The foot sleeve has several advantages. It requires much less operating force so it can be operated with smaller pressure differentials, and should the occasion arise it can be operated by wireline. Also, the foot sleeve can be operated with a conductor line passing through it.

It will be appreciated that before the tubing engages the packer in any of the above described operations, the fluid in the tubing string may have its weight changed to provide the desired tubing pressure. For instance, nitrogen gas may be injected or diesel oil may be pumped in. The degree of unbalance of the U-tube formed by the open ended tubing and the annulus will be shown by the pressure at the top of the tubing.

It will further be appreciated that at all of the stages of the method a test of surface equipment is possible with the foot valve either in open or closed position, as desired. Prior to running the transducer or the pressure bomb, the well can be flowed to fill the tubing with formation fluids before wireline operations are started.

If desired in order to pressure up the annulus to close the foot valve, the well can be flowed at a slow rate to establish the annulus pressure required for closing.

After the transducer has been pulled from the transducer fitting, it can be left suspended near the bottom of the tubing to monitor the next step in the method as desired.

This step is conditioning annulus fluid to attain the desired bottom hole pressure, which may be higher or lower than formation pressure.

When finally putting the well on production, lowering the tubing to install it in the packer will normally result in the foot valve opening. At this time the pressure within the tubing string can be contained by either the subsurface safety valve 32 or by a wellhead plug.

The foregoing disclosure and description of the invention are illustrative and explanatory thereof and various changes in the size, shape and materials, as well as in the details of the illustrated construction, and various changes in the process may be made within the scope of the appended claims without departing from the spirit of the invention.

What is claimed is:

1. The method of operating a well comprising, providing in a well a packer, a foot valve and pressure sensing means below the packer exposed to formation fluids, and a separate tubing landed in the packer providing an annulus above the packer and exterior of the tubing and including a pressure responsive valve actuator extending through the packer and engageable with said foot valve, alternately raising and lowering annulus pressure to raise and lower said valve actuator between valve open position to flow the well and valve closed position to shut-in the well to determine flow characteristics of the well and formation pressures, completing surface connections and suspension of said tubing for production of the well, and maintaining pressure in the annulus on the pressure responsive actuator such that the annulus-tubing differential positions said valve actuator in the down position during normal flow conditions and raises the valve actuator to the up position upon an abnormal loss of pressure in the tubing.

2. The method of claim 1 wherein prior to completing surface connections and suspension of the tubing the tubing is raised to foot valve closing position, and the tubing is temporarily suspended in the well until the well is completed for production.

3. The method of claim 1 wherein prior to completing surface connections and suspension of the tubing the foot valve is closed and the tubing is temporarily suspended in the well until the well is completed for production.

4. The method of operating a well comprising, setting a packer having a depending foot valve and landing nipple in a well, landing in the packer a tubing including a pressure responsive telescoping joint and a depending valve actuator providing an annulus above the packer and exterior of the tubing, landing a transducer fitting in said landing nipple, increasing pressure in the annulus to raise the valve actuator and close the foot valve, landing a transducer in the transducer fitting, and alternately opening said foot valve to flow the well and closing said foot valve to determine formation pressures by increasing and decreasing pressure in the well annulus, raising said tubing to close said foot valve and suspending said tubing in the well at the completion of testing operations, and completing the well by relanding said tubing in the packer, pressuring up the annulus to close the foot valve, completing the well at the surface, reducing pressure on the annulus to open the foot valve and place the well on production, and maintaining pressure in the annulus at the telescoping joint such that the annulus-tubing differential positions said valve actuator in the down position during normal flow conditions and raises the valve actuator to the up position upon an abnormal loss of pressure in the tubing.

5. The method of claim 4 wherein the landing nipple when run has suspended therein a plug, and said plug is removed after said tubing is landed and prior to running said transducer fitting.

6. A well system comprising, a packer having a bore therethrough, a depending foot valve, and a landing nipple, a pressure sensing device in said landing nipple, a foot valve actuator having a sliding seal with said packer bore and engageable with said foot valve to move said foot valve between open and closed positions, a tubular telescoping joint attached to said actuator, said telescoping joint having a seal area of greater diameter than said seal between the actuator and packer bore exposed to pressure externally of said joint on the actuator side of the joint and to pressure within said joint on the side opposite said actuator.

7. The method of operating a well comprising, providing in a well a packer, a foot valve and pressure sensing means below the packer exposed to formation fluids, providing a tubing string having a telescoping joint in the tubing string providing therebelow an independently movable portion of said tubing string landed in the packer and including a pressure responsive valve actuator extending through the packer and engageable with said foot valve, said tubing string and well providing an annulus above the packer and exterior of the tubing, alternately raising and lowering annulus pressure to raise and lower said valve actuator between valve open position to flow the well and valve closed position to shut-in the well to determine flow characteristics of the well and formation pressures, suspending said tubing string from the wellhead, maintaining annulus pressure at a level to raise said valve actuator to valve closed position while completing surface connections, and maintaining pressure in the annulus at said movable portion of the tubing string such that the annulus-tubing differential positions said valve actuator in the down position to open said foot valve during normal flow conditions and raises the valve actuator to the up position to close said foot valve upon an abnormal loss of pressure in the tubing.

8. The method of operating a well comprising, providing in a well a packer having a foot valve suspended below the packer controlling flow through the bore in the packer and a transducer fitting and a tubing landed in the packer and providing an annulus above the packer and exterior of the tubing, maintaining said foot valve in closed position while running a transducer fitting into the well and continuously sensing conditions at the transducer and transmitting such conditions to the surface, landing said transducer in said transducer fitting and thereafter transmitting to the surface well conditions below the packer, and alternately raising and lowering annulus pressure to open and close said foot valve to determine flow characteristics of the well and formation pressures with the formation flowing and shut-in.

9. The method of operating a well comprising, providing in a well a packer, a foot valve and pressure sensing means below the packer exposed to formation fluids, and a separate tubing landed in the packer providing an annulus above the packer and exterior of the tubing and including a pressure responsive valve actuator extending through the packer and engageable with said foot valve, alternately raising and lowering annulus pressure to raise and lower said valve actuator between valve open position to flow the well and valve closed position to shut-in the well to determine flow characteristics of the well and formation pressures, and raising the tubing at any time during the test procedure to close the foot valve to isolate the formation to permit conditioning of fluids in the well above the packer.

* * * * *